US006992272B2

(12) United States Patent
Kitano et al.

(10) Patent No.: US 6,992,272 B2
(45) Date of Patent: Jan. 31, 2006

(54) THERMAL PROCESSING ROLLER AND TEMPERATURE CONTROL APPARATUS FOR ROLLER

(75) Inventors: Yoshio Kitano, Kyoto (JP); Toru Tonomura, Kyoto (JP); Kozo Okamoto, Kyoto (JP); Shigeyuki Hirota, Kyoto (JP); Masanobu Heguri, Kyoto (JP); Toshiki Hanafusa, Kyoto (JP)

(73) Assignee: Tokuden Co., Ltd., Kyoto (JP)

( * ) Notice: Subject to any disclaimer, the term of this patent is extended or adjusted under 35 U.S.C. 154(b) by 73 days.

(21) Appl. No.: 10/667,307

(22) Filed: Sep. 23, 2003

(65) Prior Publication Data

US 2004/0089654 A1 May 13, 2004

(30) Foreign Application Priority Data

Sep. 24, 2002 (JP) ..... P. 2002-276652
Dec. 20, 2002 (JP) ..... P. 2002-369362

(51) Int. Cl.
*H05B 6/14* (2006.01)

(52) U.S. Cl. ..... 219/619; 399/330; 219/469; 165/90

(58) Field of Classification Search ..... 219/619, 219/469, 470, 497, 216, 492, 501; 399/328, 399/329, 330–333, 69, 70, 334; 118/60; 165/90; 492/46

See application file for complete search history.

(56) References Cited

U.S. PATENT DOCUMENTS

| | | | | |
|---|---|---|---|---|
| 5,549,154 | A | | 8/1996 | Niskanen et al. |
| 5,590,704 | A | * | 1/1997 | Eriksen et al. ..... 165/90 |
| 5,773,796 | A | * | 6/1998 | Singer et al. ..... 219/470 |
| 6,339,211 | B1 | * | 1/2002 | Foote et al. ..... 219/216 |
| 6,554,755 | B2 | * | 4/2003 | Kubik ..... 492/46 |
| 6,580,895 | B2 | * | 6/2003 | Hirst et al. ..... 399/330 |
| 2002/0088120 | A1 | | 7/2002 | Laitinen et al. |

FOREIGN PATENT DOCUMENTS

| | | |
|---|---|---|
| DE | 199 36 077 A1 | 4/2001 |
| GB | 1 417 991 A | 12/1975 |

* cited by examiner

*Primary Examiner*—Quang Van
(74) *Attorney, Agent, or Firm*—Morgan, Lewis & Bockius LLP

(57) ABSTRACT

A thermal processing roller includes a heat transfer medium flowing path therein and heats a member to be processed abutting against a surface of the roller or absorbs heat therefrom by heat transfer fluid flowing through the heat transfer medium flowing path, wherein a sealed chamber extending in a longitudinal direction of the roller and in which heat transfer medium of vapor-liquid two phases is sealed is formed within a thick portion of the roller.

15 Claims, 7 Drawing Sheets

THERMAL PROCESSING ROLLER AND TEMPERATURE CONTROL APPARATUS FOR ROLLER

BACKGROUND OF THE INVENTION

1. Field of the Invention

The present invention relates to a thermal processing roller for subjecting a member to be processed such as a resin film to a heating processing or a heat-absorbing processing by using fluid as heat transfer medium, and relates to a temperature control apparatus for the roller.

2. Description of the Related Art

In general, when a member to be processed such as a resin film is applied to a roller, the member is heated to a predetermined temperature or the member at a high temperature is cooled to a predetermined temperature while the member is abutted against and passes through the roller. In the case of performing the heating processing, the roller is heated to a temperature necessary for the heating processing. In contrast, in the case of performing the heat-absorbing processing, since the temperature of the roller itself increases due to heat absorbed from the member to be processed, the roller is cooled to a temperature suitable for the cooling processing thereof. In each case, medium for carrying or transferring heat is required, and fluid such as oil is used for the medium. That is, the fluid at a suitable temperature is passed within the roller, whereby roller is heated or heat is absorbed from the roller by using the fluid.

FIG. 12 shows the schematic configuration of an example of such a thermal processing roller apparatus. In FIG. 12, 1 depicts a roll shell constituting a roller main body, 2 a rotation driving shaft which is rotated by a not-shown motor to rotate the roll shell, 3 an inner core, 4 a rotary joint, 5 an oil storage tank, 6 oil (heat transfer fluid), 7 a heat exchanger (for heating or cooling), 8 a pump, 9 a temperature sensor, 10 a temperature control apparatus, 11 an electric power control circuit, 12 a heater and 13 a member to be processed such as a resin film which abuts against the roll shell and passes therethrough. The roll shell 1 is configured in a cylindrical shape. The inner core 3 is disposed within the hollow portion of the roll shell and a heat transfer medium flowing path 3*a* is formed within the inner core 3 so as to pass through the center portion thereof. The heat transfer medium flowing path 3*a* is coupled to the inflow port of the rotary joint 4 through the inner portion of the rotation driving shaft 2. A heat transfer medium flowing path 1*a* formed between the inner peripheral wall of the roll shell 1 and the outer peripheral wall of the inner core 3 is coupled to the outlet of the rotary joint 4 through the inner portion of the rotation driving shaft 2.

That is, the oil 6 within the oil storage tank 5 is heated or cooled to the predetermined temperature when passing through the heat exchanger 7. Then, the oil 6 is sent within the roll shell 1 by the pump 8, then flows through the heat transfer medium flowing paths 3*a*, 1*a* and is exhausted into the oil storage tank 5. At the time of heating the member to be processed 13, the oil 6 is heated by the heater 12 within the heat exchanger 7 and the oil 6 thus heated passes through the heat transfer medium flowing paths 3*a*, 1*a* within the roll shell 1. Thus, the roll shell 1 is heated, so that the member to be processed 13 abutting against the surface of the roll shell 1 is heated by the heat of the roll shell or the heat is absorbed from the member to be processed.

The temperature sensor 9 for detecting the temperature of the oil (heat transfer fluid) thus flown is provided at the output side of the heat exchanger 7. A detected temperature signal from the temperature sensor 9 is sent to the temperature control apparatus 10. A setting temperature S (see FIG. 13) for setting the temperature of the oil 6 thus flown is inputted in the temperature control apparatus 10 in advance. The temperature control apparatus compares the setting temperature S with the detected temperature signal thus inputted from the temperature sensor 9 and sends a control signal corresponding to the deviation therebetween to the electric power control circuit 11 constituted by a thyristor etc. The electric power control circuit 11 supplies electric power corresponding to the control signal to the heater 12. Thus, the heater 12 is heated by the electric power thus supplied to heat the heat transfer fluid 6 to the setting temperature S and maintain the heated temperature.

In such a thermal processing heater, there arises a difference between the temperature of the heat transfer fluid flowing into the roller (formed by coupling the rotation driving shaft to the roll shell) and the temperature of the heat transfer fluid flowing therefrom after heating the member to be processed or absorbing heat from the member to be processed. The temperature difference appears on the surface of the roller, so that there arises a problem that the thermal processing can not be performed uniformly as to the member to be processed abutting against the surface of the roller, in the longitudinal direction of the member to be processed along the axis core of the roller. In order to obviate such a problem, in the related technique, a flow rate of the heat transfer fluid flowing within the roller is increased in accordance with the magnitude of the temperature difference in order to reduce the temperature difference. Thus, there arises a problem that the heat exchanger for heating or cooling and the pump become inevitably larger.

Further, according to such the temperature control for the heat transfer fluid 6, as shown in FIG. 13, initially, the rising rate of the surface temperature T2 of the roll shell 1 is lower as compared with the rising rate of the temperature T1 of the heat transfer fluid 6, so that a time period t1 required for the surface temperature T2 of the roll shell 1 to increase near the setting temperature S becomes long. In particular, when an amount of the heat transfer fluid 6 flowing within the roll shell 1 is small, the heat transfer rate at the heat transfer surface (inner surface) of the roll shell 1 through which the heat transfer fluid 6 flows becomes low, so that the time period tends to be longer.

Furthermore, as shown in FIG. 13, there arises a deviation d1 between the surface temperature T2 of the roll shell 1 and the temperature T1 of the heat transfer fluid 6 due to such a fact that the temperature of the heat transfer fluid 6 controlled at the setting temperature S reduces at a pipe provided on the way of the flow, or that a temperature difference is caused within the thick portion from the heat transfer surface (inner surface) to the surface (outer surface) of the roll shell 1 through which the heat transfer fluid 6 flows. When the member to be processed 13 abuts against and passes through the surface of the roll shell 1, since the member to be processed 13 absorbs the heat from the surface of the roll shell, the surface temperature of the roll shell reduces, so that the deviation becomes a larger value d2. In order to prevent such a phenomenon, a flow rate of the heat transfer fluid 6 is required to increase. As a result, there arises a problem that the heat exchanger and the pump are required to be larger.

SUMMARY OF THE INVENTION

The invention has been made in view of the aforesaid problem of the conventional technique, and an object of the present invention is to provide a thermal processing roller and a temperature control apparatus for the roller which can perform uniform thermal processing of a member to be processed, miniaturize a heat exchanger and a pump, and perform uniform thermal processing of the member to be processed without enlarging the heat exchanger and the pump.

The invention according to first aspect is characterized in that the thermal processing roller which includes a heat transfer medium flowing path therein and heats a member to be processed abutting against a surface of the roller or absorbs heat therefrom by heat transfer fluid flowing through the heat transfer medium flowing path, wherein a sealed chamber extending in a longitudinal direction of the roller and in which heat transfer medium of vapor-liquid two phases is sealed is formed within a thick portion of the roller.

The invention according to second aspect is characterized in that the thermal processing roller which includes a heat transfer medium flowing path therein and heats a member to be processed abutting against a surface of the roller or absorbs heat therefrom by heat transfer fluid flowing through the heat transfer medium flowing path, wherein a plurality of sealed chambers each extending in a longitudinal direction of the roller and in each of which heat transfer medium of vapor-liquid two phases is sealed are formed within a thick portion of the roller along an outer peripheral surface of the roller, tubes respectively penetrating within the sealed chambers in a longitudinal direction thereof are provided, and the tubes are used as the heat transfer medium flowing path.

The invention according to third aspect is characterized in that in the thermal processing roller according to first or second aspect, an electromagnetic induction heating mechanism is further provided.

The invention according to fourth aspect is characterized in that in the temperature control apparatus for the thermal processing roller according to first, second or third aspect, the apparatus includes: heat transfer fluid supply unit for supplying heat transfer fluid to the thermal processing roller; a first temperature sensor for detecting a temperature of the heat transfer fluid supplied from the heat transfer fluid supply unit; first temperature control unit for comparing a temperature detected by the first temperature sensor with a first setting temperature to control a temperature of the heat transfer fluid to the first setting temperature; a second temperature sensor for detecting a surface temperature of the thermal processing roller; second temperature control unit for comparing a temperature detected by the second temperature sensor with a second setting temperature different from the first setting temperature to control a temperature of the heat transfer fluid to the second setting temperature; and switching unit for changing into the second temperature control unit when a difference between the temperature detected by the second temperature sensor and the second setting temperature is within a predetermined range, whilst changes into the first temperature control unit when the difference exceeds the predetermined range.

The invention according to fifth aspect is characterized in that in the temperature control apparatus for the thermal processing roller according to first, second or third aspect, the apparatus includes: heated transfer fluid supply unit for supplying heated transfer fluid to the thermal processing roller; a first temperature sensor for detecting a temperature of the heated transfer fluid supplied from the heated transfer fluid supply unit; first temperature control unit for comparing a temperature detected by the first temperature sensor with a first setting temperature to control a temperature of the heated transfer fluid to the first setting temperature; a second temperature sensor for detecting a surface temperature of the thermal processing roller; second temperature control unit for comparing a temperature detected by the second temperature sensor with a second setting temperature lower than the first setting temperature to control a temperature of the heated transfer fluid to the second setting temperature; and switching unit for changing into the second temperature control unit when a difference between the temperature detected by the second temperature sensor and the second setting temperature is within a predetermined value, whilst changes into the first temperature control unit when the difference exceeds the predetermined value.

The invention according to sixth aspect is characterized in that in the temperature control apparatus for the thermal processing roller according to first, second or third aspect, the apparatus includes: heat absorbing fluid supply unit for supplying heat absorbing fluid to the thermal processing roller; a first temperature sensor for detecting a temperature of the heat absorbing fluid supplied from the heat absorbing fluid supply unit; first temperature control unit for comparing a temperature detected by the first temperature sensor with a first setting temperature to control a temperature of the heat absorbing fluid to the first setting temperature; a second temperature sensor for detecting a surface temperature of the thermal processing roller; second temperature control unit for comparing a temperature detected by the second temperature sensor with a second setting temperature higher than the first setting temperature to control a temperature of the heat absorbing fluid to the second setting temperature; and switching unit for changing into the second temperature control unit when a difference between the temperature detected by the second temperature sensor and the second setting temperature is within a predetermined value, whilst changes into the first temperature control unit when the difference exceeds the predetermined value.

The invention according to seventh aspect is characterized in that in the temperature control apparatus for the thermal processing roller according to fourth, fifth or sixth aspect, the second temperature sensor for detecting a surface temperature of the thermal processing roller is inserted into a thick portion near a surface of the roller.

According to the thermal processing roller according to the invention, the sealed chamber extending in the longitudinal direction of the roller and in which the heat transfer medium of vapor-liquid two phases is sealed is provided within the thick portion of the roller. Thus, even if there arises a difference between the temperature of the heat transfer fluid flowing into the roller and the temperature of the heat transfer fluid flowing from the roller after heating the member to be processed or absorbing heat therefrom, due to the movement of the latent heat of the heat transfer medium of the vapor-liquid two phases, the surface temperature of the roller in the longitudinal direction along the axis core of the roller is made uniform. Thus, the uniform thermal processing can be performed as to the member to be processed abutting against the roller in the longitudinal direction along the axis core of the roller without increasing a flow rate of the heat transfer fluid. Further, when the electromagnetic induction heating mechanism is added, a response speed reaching a necessary temperature can be made faster by suitably driving the electromagnetic induction heating mechanism, for example, by driving the mechanism at the time of changing the processing temperature etc.

Further, according to the temperature control apparatus according to the invention, when the surface temperature of the roller is lower (higher in the case of heat absorption) than the predetermined range of the target value (the second setting temperature), the control is performed by the temperature control unit (the first temperature control unit) in which the temperature of the heat transfer fluid is set to a value (the first setting temperature) higher (lower in the case of heat absorption) than the target value of the surface temperature of the roller. In contrast, when the surface temperature of the roller is within the predetermined range of the target value (the second setting temperature), the control is performed by the temperature control unit (the second temperature control unit) in which the temperature of the heat transfer fluid is set to the target value (the second setting temperature) of the surface temperature of the roller. Thus, at the initial stage where the surface temperature of the roller is quite smaller as compared with the target value, the surface temperature of the roller can be raised rapidly near the target value.

After the surface temperature of the roller reaches the target value, when the member to be processed passes through the surface of the roller, the surface temperature of the roller reduces (increases in the case of heat absorption). When the reduction exceeds the predetermined range of the target value of the surface temperature of the roller, for example, 10% (suitably changed) of the target value, the control is performed by the temperature control unit (the first temperature control unit) in which the temperature of the heat transfer fluid is set to a value (the first setting temperature) higher (lower in the case of heat absorption) than the target value of the surface temperature of the roller. Thus, the surface temperature of the roller is almost kept to the target value, and so the uniform thermal processing of the member to be processed can be performed without enlarging the heat exchanger and the pump.

In this case, when the second temperature sensor for detecting the surface temperature of the thermal processing roller is inserted within the thick portion of the roller near the surface of the roller, the surface temperature of the roller can be detected accurately and stably and the interference between the temperature sensor and the member to be processed can be prevented. Further, since the heat transfer medium of vapor-liquid two phases is sealed into the sealed chamber formed along the longitudinal direction of the roller, even if there is a temperature difference in the heat transfer fluid between the fluid inlet and the fluid outlet, the surface temperature of the roller is kept at the uniform value due to the movement of the latent heat of the heat transfer medium. Thus, the uniform thermal processing can be performed in the width direction (the longitudinal direction of the roller) of the member to be processed passing through the surface of the roller. Further, since the surface of the roller is uniform, the surface temperature of the roller can be detected easily.

BIRED DESCRIPTION OF THE DRAWINGS

DETAILED DESCRIPTION OF THE PREFERRED EMBODIMENTS

Figure 1:
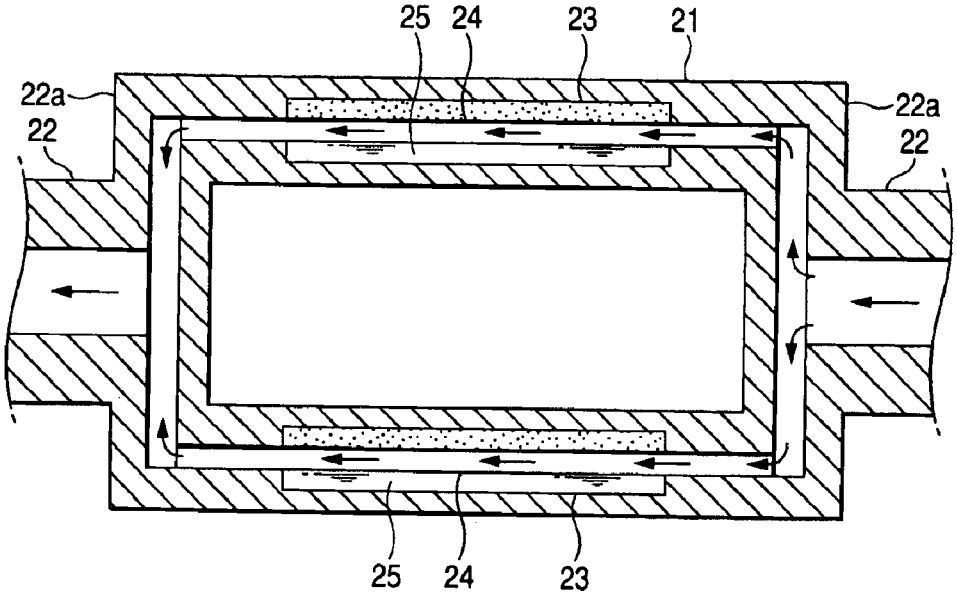
FIG. 1 is a longitudinal sectional diagram of a heat transfer medium flowing roller according to an embodiment of the invention.
Figure 2:
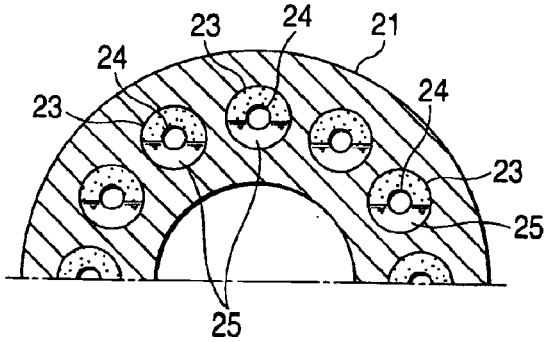
FIG. 2 is a transversal sectional diagram showing a part of the heat transfer medium flowing roller shown in FIG. 1.
Figure 3A:
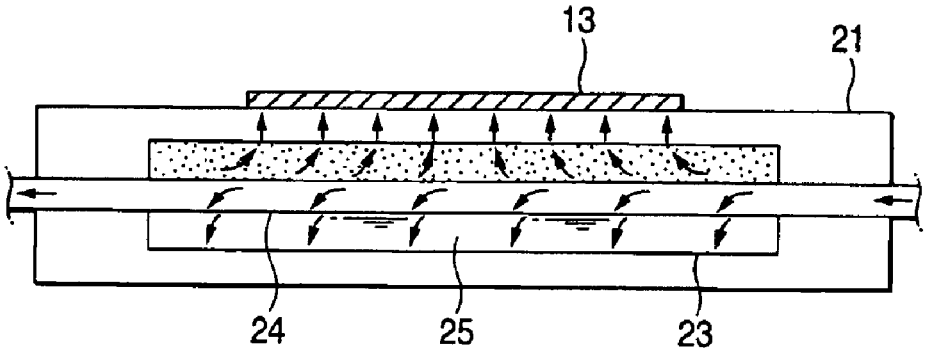
FIG. 3 is diagrams for explaining the operation of the heat transfer medium flowing roller shown in FIG. 1.
Figure 3B:
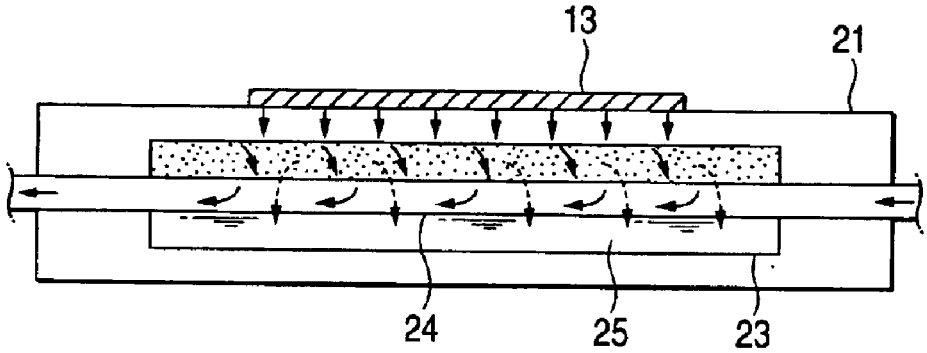
Figure 12:
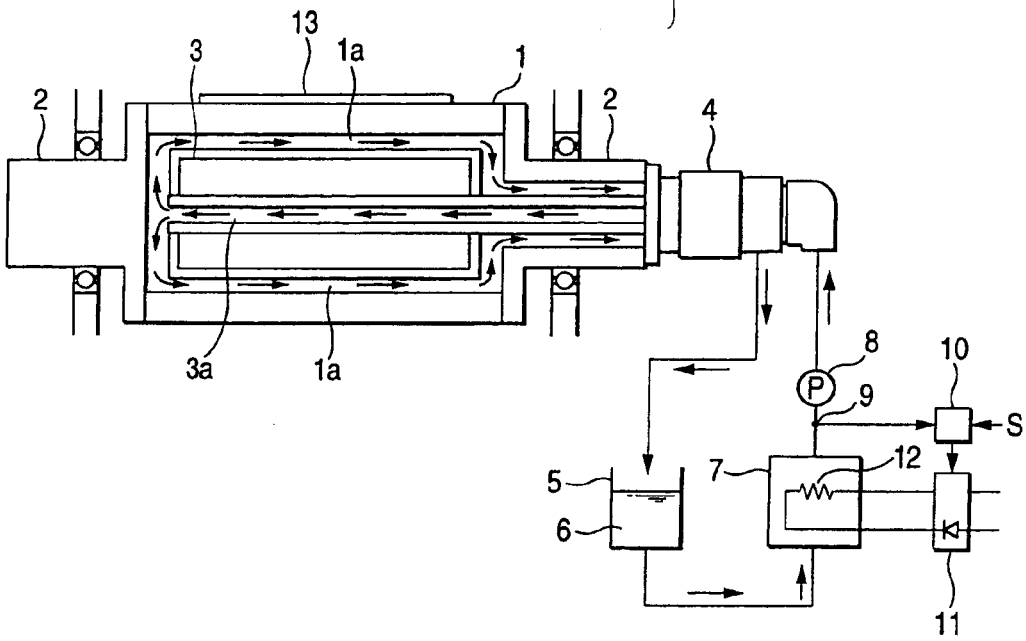
FIG. 12 RELATED ART
FIG. 12 is a diagram showing the configuration of a conventional thermal processing roller apparatus.
Figure 13:
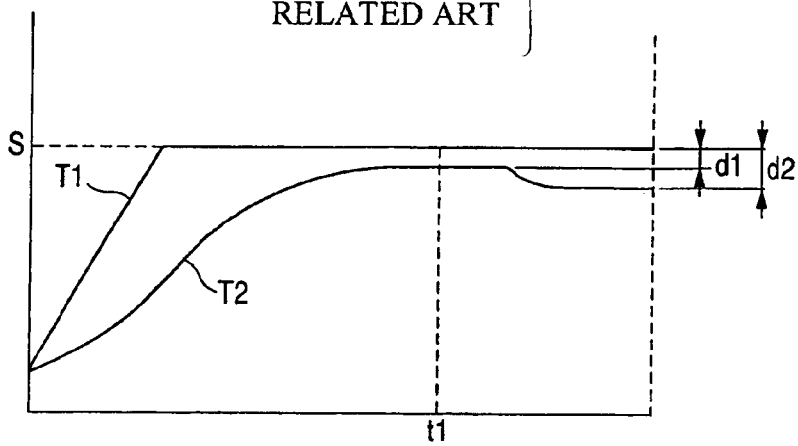
FIG. 13 RELATED ART
FIG. 13 is a characteristic diagram showing the operation of the temperature control apparatus for the thermal processing roller shown in FIG. 12.

The embodiments of the invention will be explained with reference to the accompanying drawings. FIG. 1 is a longitudinal sectional diagram of a thermal processing roller according to an embodiment, FIG. 2 is a transversal sectional diagram showing a part thereof, and FIG. 3 is diagrams for explaining the operation thereof, in which FIG. 3A and FIG. 3B are diagrams for explaining the operations at the time of heating and heat-absorbing, respectively. The circulation path of the heat transfer fluid formed by the rotary joint 4, the oil storage tank 5, the heat exchanger 7 for heating or cooling, the temperature sensor 9 and the pump 8 shown in FIG. 12 is abbreviated in the drawings.

In FIGS. 1 to 3, 13 depicts a member to be processed such as a resin film, 21 a roll shell, 22 a rotation driving shaft, 23 a sealed chamber, 24 a heat transfer medium flowing tube and 25 heat transfer medium forming vapor-liquid two phases.

The roll shell 21 is configured in a cylindrical shape and the end portions at the both sides in the longitudinal direction thereof are coupled and fixed to the flanges 22*a* of the rotation driving shaft 22. The sealed chamber 23 is formed in a manner that a hole is formed by unit of a drill within the thick portion of the roll shell 21 from the end edges in the longitudinal direction of the roll shell 21 along the longitudinal direction, and a suitable amount of the heat transfer medium of the vapor-liquid two phases such as water 25 is injected into the hole to close the opening portion. As shown in FIG. 2, a plurality of the sealed chambers are provided with a suitable interval along the outer peripheral surface of the roller.

The heat transfer medium flowing tube 24 penetrates within the sealed chamber 23 along the longitudinal direction thereof and extends to the end edges at the both sides in the longitudinal direction of the roll shell 21. A heat transfer medium flowing hole is formed at the rotation driving shaft 22 and the flange 22*a* thereof and communicates with the heat transfer medium flowing tube 24. That is, the heat transfer fluid such as oil for heating the roll shell 21 or absorbing heat therefrom fed through the not-shown heat exchanger for heating or cooling, the not-shown pump and the not-shown rotary joint passes the heat transfer medium flowing tubes 24 through the heat transfer flowing hole of the one rotation driving shaft 22 and the flange 22*a* thereof and then is exhausted to an oil storage tank through the heat transfer flowing hole of the other rotation driving shaft 22, the flange 22*a* thereof and the rotary joint.

In the case of heating the member to be processed 13 such as a resin film, the heat transfer fluid heated to a predetermined temperature (heated transfer fluid) is used. However, when the heat transfer fluid passes through the heat transfer medium flowing tube 24, as shown in FIG. 3A, the heat transfer medium 25 within the sealed chamber 23 is heated and evaporated and the heat of the gas thus evaporated is applied to the member to be processed through the roll shell 21 thereby to heat it. The gas from which the heat is absorbed is liquefied and heated again by the heat transfer fluid and so evaporated. Then, the heat of the gas thus evaporated is applied to the member to be processed 13 through the roll shell 21 thereby to heat it. Such an operation is repeatedly performed. At the time of heating the member to be processed 13, the heat of the gas thus evaporated moves to the lower-temperature side against which the member to be processed 13 abuts. Thus, even if there arises such a temperature difference that the temperature at the inflow side of the heat transfer fluid is high and the temperature at the outflow side of the heat transfer fluid is low, the uniform heating processing can be performed as to the member to be processed 13 in the longitudinal direction along the axis core of the roller.

Further, in the case of absorbing heat from the member to be processed 13 such as a resin film at a high temperature to reduce the temperature thereof to a predetermined value, the heat transfer fluid heated to a predetermined temperature is used in order to prevent the further reduction of the temperature of the member to be processed. However, when the heat transfer fluid passes through the heat transfer medium flowing tube 24, as shown in FIG. 3B, the heat of the roll shell 21 heated by the member to be processed 13 is transmitted to the heat transfer medium of the vapor-liquid two phases within the sealed chamber 23 and cooled to a predetermined temperature by the heat transfer fluid passing through the heat transfer medium flowing tube 24. In this case, even if there arises such a temperature difference that the temperature at the inflow side of the heat transfer fluid is low and the temperature at the outflow side of the heat transfer fluid is high, the heat of the gas moves to the lower-temperature side, so that the uniform heat-absorbing processing can be performed as to the member to be processed 13 in the longitudinal direction along the axis core of the roller.

In this embodiment, since the flow path of the heat transfer fluid does not directly contact with the roll shell 21, deterioration of mechanical accuracy due to thermal expansion coefficient difference of the roll shell 21 can be suppressed and also the fluid can be effectively acted on the necessary heating portion and heat-absorbing portion.

Figure 4:
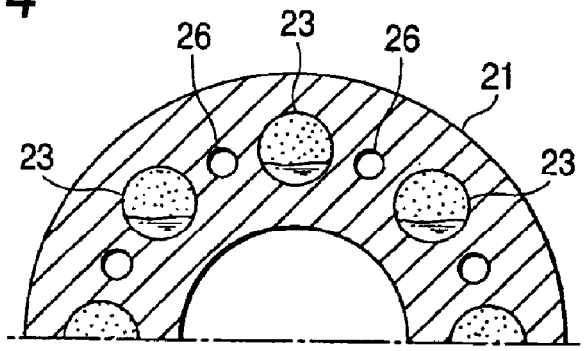
FIG. 4 is a transversal sectional diagram showing a part of the heat transfer medium flowing roller according to another embodiment of the invention.

FIG. 4 is a transversal sectional diagram showing a part of another embodiment like FIG. 2. The heat transfer fluid flowing roller according to the another embodiment differs from the thermal processing roller shown in FIGS. 1 and 2 in a manner that a heat transfer medium flowing hole 26 penetrating through the thick portion of the roll shell 21 is formed in parallel to the sealed chambers 23 between each adjacent pair of sealed chambers 23 housing the heat transfer medium of the vapor-liquid two phases. According to the heat transfer fluid flowing roller thus configured, the roll shell 21 is heated or heat thereof is absorbed directly by the heat transfer fluid passing through the heat transfer medium flowing holes 26. Due to the movement of the latent heat of the heat transfer medium of the vapor-liquid two phases within the sealed chambers 23, like the thermal processing roller shown in FIGS. 1 and 2, the uniform heating and heat-absorbing processings can be performed as to the member to be processed in the longitudinal direction along the axis core of the roller.

Figure 5:
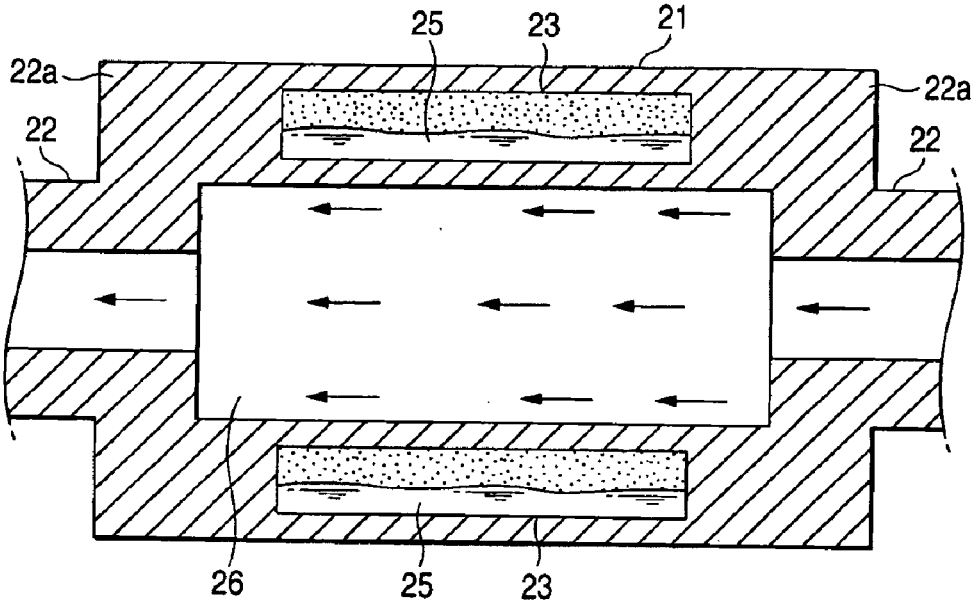
FIG. 5 is a longitudinal sectional diagram showing the heat transfer medium flowing roller according to the another embodiment of the invention.
Figure 6:
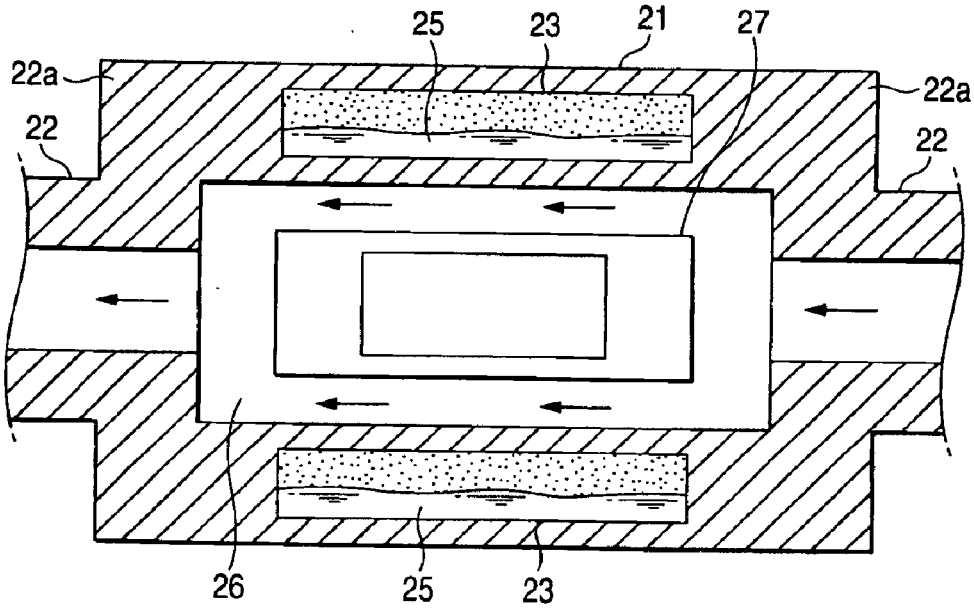
FIG. 6 is a longitudinal sectional diagram showing the heat transfer medium flowing roller according to still another embodiment of the invention.
Figure 7:
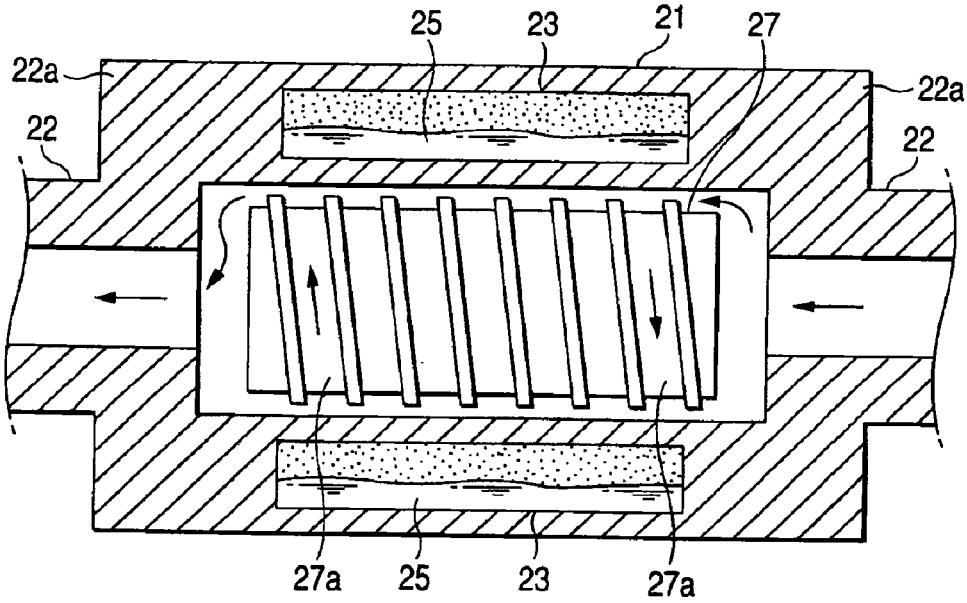
FIG. 7 is a longitudinal sectional diagram showing the heat transfer medium flowing roller according to still another embodiment of the invention.

FIGS. 5 to 7 show other embodiments in the case of flowing the heat transfer medium within the hollow portion of the roll shell 21 to directly heat the roll shell 21 or directly absorb heat therefrom, respectively. In the embodiment shown in FIGS. 6 and 7, an inner core 27 is disposed within the hollow portion of the roll shell 21, so that a flow rate of the heat transfer fluid can be made fast. In the embodiment shown in FIG. 7, since a spiral groove 27*a* is formed at the inner core 27, the heat transfer fluid flows along the spiral groove 27*a*, so that more amount of the heat transfer fluid can flow within the hollow portion of the roll shell 21. Incidentally, in these figures, portions corresponding to those of the thermal processing roller shown in FIGS. 1, 2 and 4 are referred to by the common symbols, and detailed explanation will be omitted as to a fact that the uniform heating and heat-absorbing processings can be performed as to the member to be processed in the longitudinal direction along the axis core of the roller.

As described above, as to the heat transfer fluid flowing roller provided with the sealed chambers 23 for housing the heat transfer medium of the vapor-liquid two phases within the thick portion of the roll shell 21, measurement is made by using fourteen temperature sensors disposed on the surface of the roll shell 21 with almost the same interval from the outlet side to the inlet side of the fluid under the condition that the diameter of the roll is 310 mm, the length of the roll surface is 1,110 mm, a fan is operated in a load state, a flow rate of the fluid is 2.4 $m^3$/h, a specific gravity of the fluid is 841 kg/$m^3$, a specific heat of the fluid is 0.42 kcal/kg, a temperature at a fluid inlet is 178° C., a temperature at a fluid outlet is 168° C. and a temperature difference between the fluid inlet and the fluid outlet is 10° C.

As a result of the measurement, the measured temperatures from the outlet side of the fluid are sequentially as follows: 146.8, 148.8, [150.6, 150.8, 150.9, 150.9, 150.9, 150.8, 150.6, 150.7, 150.5, 150.3], 149.4 and 147.8. The temperatures within the parenthesis are those at the portion of the effective length of the sealed chamber 23 housing the heat transfer medium of the vapor-liquid two phases and the effective length 960 mm of the width of the member to be processed. The temperature difference of this range is 0.6° C. and so represents good temperature distribution despite that the temperature difference between the fluid inlet and the fluid outlet is 10° C. Incidentally, the temperatures outside of the parenthesis are those at the portion other than the roll effective length which is other than the effective length of the sealed chamber, in which the heat is absorbed by the rotation driving shaft and so the temperature is slightly reduced.

A heat value emitted from the roll is obtained as follows:

$$Q(\text{kcal/h})=10\times2.4\times841\times0.42\approx8{,}477\ \text{kcal/h}=9.86\ \text{kw}.$$

A flow rate V for obtaining the temperature difference 0.6° C. without providing the sealed chambers housing the heat transfer medium of the vapor-liquid two phases will be as follows:

$$V(\text{m}^3/\text{h})=8{,}477/(0.6\times841\times0.42)=40\ (\text{m}^3/\text{h})$$

This expression unit that a flow rate of the fluid almost 16.7 times as large as that in the case of providing the sealed chambers housing the heat transfer medium of the vapor-liquid two phases is necessary.

In other words, in the case of providing the sealed chambers 23 housing the heat transfer medium of the vapor-liquid two phases, a flow rate of the fluid only almost 1/16.7 times as large as that of not providing the sealed chambers is required. In this case, it is possible to make the sectional area of each of the pipe and the rotary joint almost 1/16.7 times as large as that of not providing the sealed chambers, so that cost for the pipe and the rotary joint can be reduced. Further, the reduction of the flow rate of the fluid results in the reduction of the number of piping procedure and a space of the equipments, which is quite advantageous in the cost reduction. Further, the reduction of the sectional area of the fluid path to almost 1/16.7 times as large as that of not providing the sealed chambers results in that the surface area of the pipe becomes almost ¼, so that heat radiation amount from the pipe also becomes ¼ and so energy-saving can be performed. The smaller the flow rate of the fluid is, the smaller the pump for supplying the fluid may be, so that when flow rate of the fluid is 1/16.7, the capacity of the pump may be sufficiently to be almost 1/10 times as large as the usual case.

The aforesaid explanation is made in the case where the temperature difference between the fluid inlet and the fluid outlet is 10° C. The reason why the temperature difference between the fluid inlet and the fluid outlet is set to 10° C. is that the temperature distribution accuracy at the effective length of the roll is usually necessary to be less than 5° C. in order to perform uniform thermal processing of the member to be processed. That is, it is necessary to set the temperature difference between the fluid inlet and the fluid outlet to be less than 5° C. In contrast, when the temperature difference between the fluid inlet and the fluid outlet becomes 5° C. or more, the flow rate is required to increase in accordance with the increase of the temperature difference between the fluid inlet and the fluid outlet in order to perform the uniform thermal processing. However, when the sealed chambers housing the heat transfer medium of the vapor-liquid two phases are provided, the uniform thermal processing can be performed sufficiently without increasing the flow rate even if the temperature difference between the fluid inlet and the fluid outlet becomes 5° C. or more. That is, by the provision of the sealed chambers housing the heat transfer medium of the vapor-liquid two phases, such a remarkable technical effects can be realized that the enlargement of the pipe, the rotary joint and the pump etc. due to the increase of the flow rate in the case where the temperature difference between the fluid inlet and the fluid outlet becomes 5° C. or more can be suppressed.

When the surface temperature of the roller (to be strictly, the roll shell) changes due to the heat absorption, the surface temperature of the roller is controlled to be constant by controlling the temperature of the heat transfer fluid. However, although the temperature control of the heat transfer fluid can be performed relatively stably, since the heat transfer coefficient between the fluid and the wall surface of the fluid path is small, the temperature of the roller does not follow the temperature of the fluid and so there arise a time delay. In order to eliminate the time delay, it is preferable to add an induction heating mechanism for causing joule heat at the roller itself.

Figure 8:
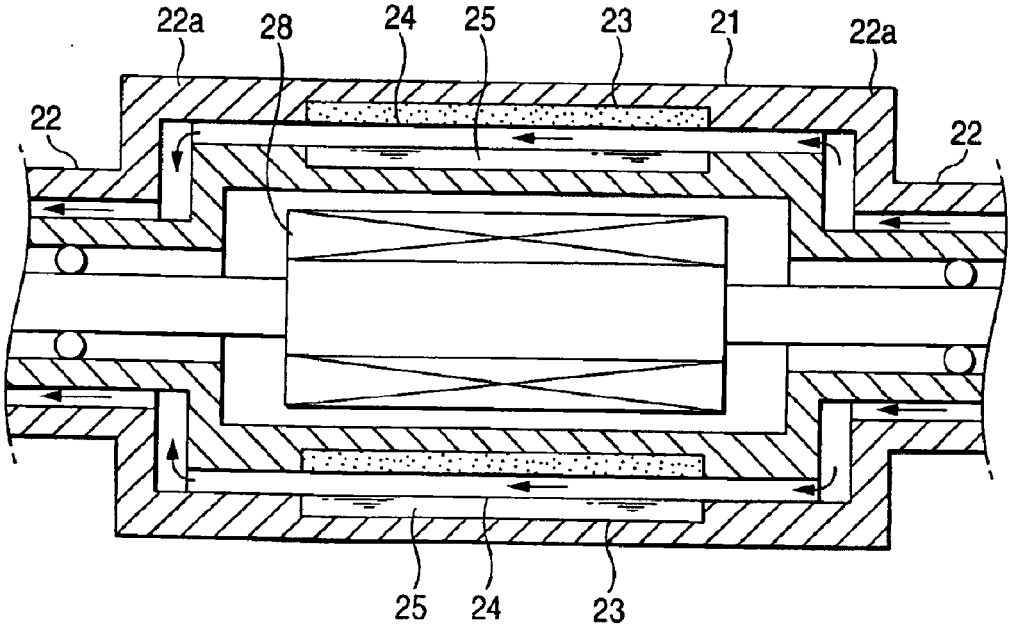
FIG. 8 is a longitudinal sectional diagram showing the heat transfer medium flowing roller according to still another embodiment of the invention.
Figure 9:
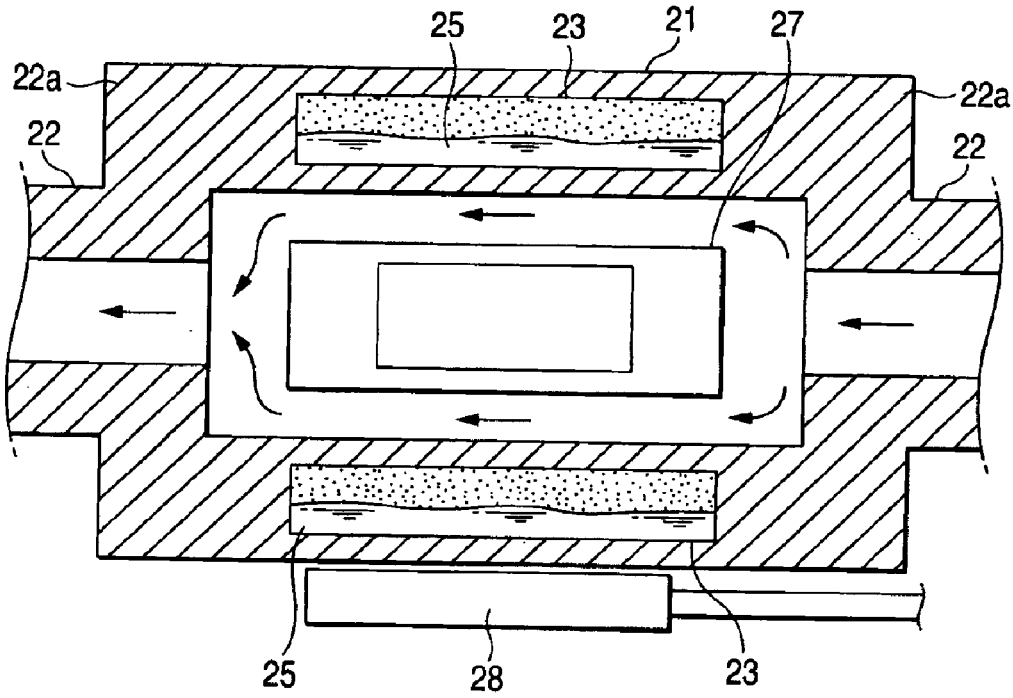
FIG. 9 is a longitudinal sectional diagram showing the heat transfer medium flowing roller according to still another embodiment of the invention.

FIGS. 8 and 9 show embodiments of the thermal processing roller to each of which an induction heating mechanism is added. The embodiment shown in FIG. 8 is arranged in a manner that an induction heating mechanism 28 formed by an induction coil and an iron core is disposed within the hollow portion of the thermal processing roller shown in FIG. 1. The embodiment shown in FIG. 9 is arranged in a manner that the induction heating mechanism 28 is disposed at a position near the outer peripheral surface of the thermal processing roller shown in FIG. 6. When the induction heating mechanism is added in this manner, the thermal processing roller can quickly cope when the processing temperature of the member to be processed is changed. Incidentally, the induction heating mechanism may be added to the thermal processing rollers shown in FIGS. 4, 5 and 7 as well as the thermal processing rollers shown in FIGS. 1 and 6.

Although in each of the aforesaid embodiments, a suitable amount of the heat transfer medium of the vapor-liquid two phases such as the water 25 is injected into the sealed chamber, a heat pipe may be inserted into the sealed chamber. Further, although the sealed chambers are provided independently, each of the sealed chambers may be communicated from one another through end portions provided at the both sides thereof. Such communication paths may be provided within the flange of the rotation driving shaft, and in this case the sealed chambers penetrate within the thick portion of the roll shell.

Figure 10:
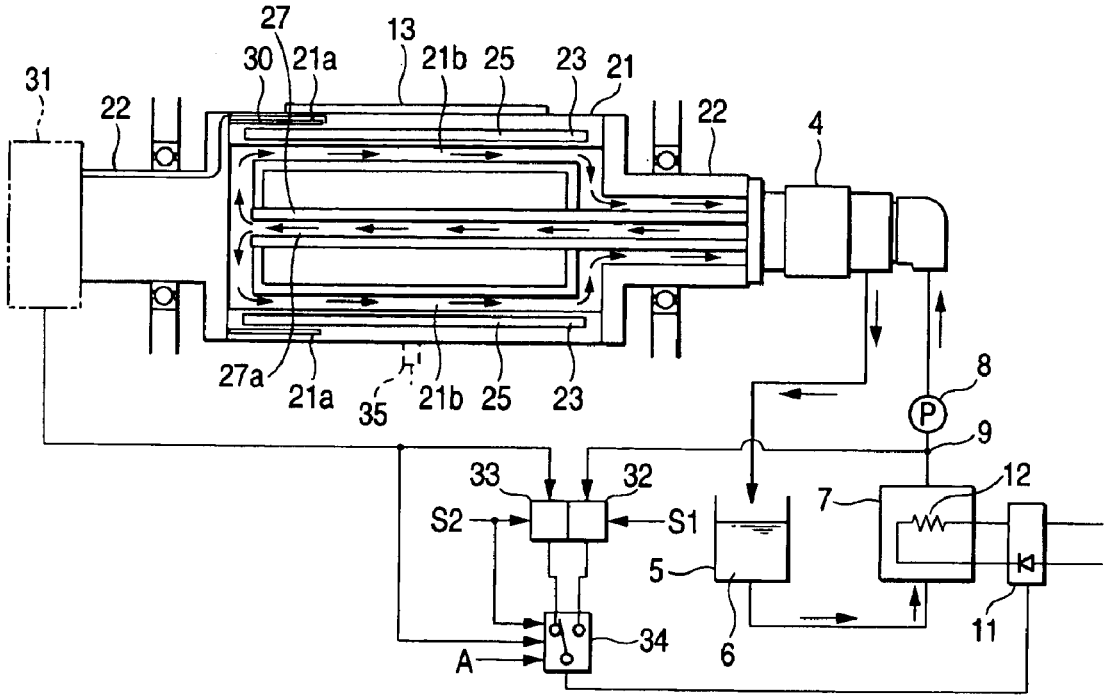
FIG. 10 is a diagram showing the configuration of the temperature control apparatus for the thermal processing roller according to an embodiment of the invention.
Figure 11:
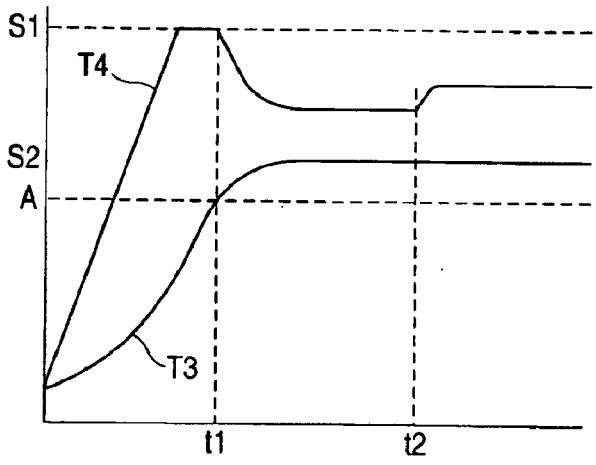
FIG. 11 is a characteristic diagram showing the operation of the temperature control apparatus for the thermal processing roller shown in FIG. 10.

Next, the temperature control of the thermal processing roller thus configured will be explained with reference to FIGS. 10 and 11. FIG. 10 is a diagram showing the configuration of the temperature control apparatus for the thermal processing roller according to an embodiment of the invention and FIG. 11 is a characteristic diagram showing the operation of the temperature control apparatus for the thermal processing roller shown in FIG. 10.

In FIG. 10, 4 depicts a rotary joint, 5 an oil storage tank, 6 oil (heat transfer fluid), 7 a heat exchanger, 8 a pump, 11 an electric power control circuit formed by a thyristor etc., 12 a heater and 13 a member to be processed such as a resin film which abuts against the roll shell and passes therethrough. The configuration of these members is same as that shown in FIG. 12. 21 depicts a roll shell having sealed chambers 23 housing heat transfer medium forming vapor-liquid two phases, 22 a rotation driving shaft which is rotated by a not-shown motor thereby to rotate the roll shell, and 27 an inner core.

The roll shell 21 is formed with a temperature sensor insertion hole 21*a*, and a temperature sensor 30 for detecting the surface temperature of the roll shell 1 is disposed within the temperature sensor insertion hole 21*a*. The inner core 27 is disposed within the hollow portion of the roll shell and a heat transfer medium flowing path 27*a* is formed so as to penetrate through the center portion of the inner core 27. The heat transfer medium flowing path 27*a* is coupled to the inflow port of the rotary joint 4 through the inner portion of the rotation driving shaft 22. A heat transfer medium flowing path 21*b* formed between the inner peripheral wall of the roll shell 21 and the outer peripheral wall of the inner core 27 is coupled to the outlet of the rotary joint 4 through the inner portion of the rotation driving shaft 22.

The oil 6 of the oil storage tank 5 passes through the heat exchanger 7 and so is heated or cooled therethrough to a predetermined temperature. The oil 6 is then fed into the roll shell 21 by the pump 8, then flows through the heat transfer medium flowing paths 27*a* and 21*b* and is exhausted into the oil storage tank 5. In the case of subjecting the member to be processed 13 to the heating processing, the oil 6 is heated by the heater 12 within the heat exchanger 7 and the oil 6 thus heated flows through the heat transfer medium flowing paths 27*a*, 21*b* within the roll shell 21. The roll shell 21 is heated by the oil thus flown and the member to be processed 13 abutting against and passing through the surface of the roll shell 21 is heated by the heat of the roll shell.

In the case of absorbing heat from the member to be processed 13, the oil 6 is cooled by coolant within the heat exchanger 7. The oil 6 thus cooled flows through the heat transfer medium flowing paths 27*a*, 21*b* within the roll shell 21. The heat of the roll shell 21 is absorbed by the oil thus flowing and the heat of the member to be processed 13 abutting against and passing through the surface of the roll shell 21 is absorbed by the roll shell. That is, the oil storage tank 5, the heat exchanger 7 and the pump 8 constitute a heat transfer fluid supply unit for supplying the heat transfer fluid 6 within the roll shell 21.

9 depicts a first temperature sensor for detecting the temperature of the heat transfer fluid to be supplied to the roll shell 21 from the heat exchanger 7, 30 a second temperature sensor for detecting the surface temperature of the roll shell 21, 31 a rotating joint such as a rotary transformer, a slip ring, a rotary connector for taking out the detected temperature of the second temperature sensor 30 to the outside of the fixed member from the roll of the rotation member, 32 a first temperature control circuit (first temperature control unit) for comparing a target value S1 (first setting temperature) of the temperature of the heat transfer fluid inputted in advance with the temperature of the heat transfer fluid detected by the first temperature sensor 9 and outputting a control signal according to the deviation therebetween to the electric power control circuit 11, and 33 a second temperature control circuit (second temperature control unit) for comparing a target value S2 (second setting temperature) of the surface temperature of the roll shell 21 inputted in advance with the surface temperature of the roll shell 21 detected by the second temperature sensor 30 and outputting a control signal according to the deviation therebetween to the electric power control circuit 11

34 depicts a switching circuit (switching unit) which changes the control signal sent to the electric power control circuit 11 to the control signal outputted from the second temperature control circuit in the case where the target value S2 (second setting temperature) of the surface temperature of the roll shell 21 is compared with the surface temperature of the roll shell 21 detected by the second temperature sensor 30 and the deviation therebetween is within a predetermined value A inputted in advance, and alternatively changes to the control signal outputted from the first temperature control circuit in the case where the deviation exceeds the predetermined value A.

In the temperature control apparatus for the thermal processing roller thus configured, in the case of heating the member to be processed 13 at 200° C., for example, the target value S2 (second setting temperature) of the surface temperature of the roll shell 21 is set to 200° C., the target value S1 (first setting temperature) of the temperature of the heat transfer fluid is set to 300° C., and the predetermined value A is set to 30° C. which is almost 15% of the target value 200° C. of the surface temperature of the roll shell 21. These values are mere examples for explanation and so they may be set suitably in the actual case.

At first, the temperature of the roll shell 21 is quite lower than the predetermined value A of 30° C., and so the switching circuit 34 sends the control signal outputted from the first temperature control circuit to the electric power control circuit 11. Then, the electric power control circuit 11 supplies the maximum electric power to the heater 12, and so the temperature of the heat transfer fluid to be supplied to the roll shell 21 increases rapidly as shown by T4 in FIG. 11. The surface temperature of the roll shell 21 also rises rapidly as shown by T3 in FIG. 11 so as to follow the temperature of the heat transfer fluid. When the surface temperature of the roll shell 21 does not reach 170° C. (200° C.−30° C.), the heat transfer fluid is kept to be heated by the control signal outputted from the first temperature control circuit. When the temperature of the heat transfer fluid reaches 300° C., the heat transfer fluid is kept to this temperature.

When the surface temperature of the roll shell 21 reaches 170° C., the switching circuit 34 performs the switching operation thereby to send the control signal outputted from the second temperature control circuit to the electric power control circuit 11. Then, the electric power control circuit 11 supplies electric power according to the deviation amount between the surface temperature of the roll shell 21, that is, the detected temperature of the second temperature sensor 30 and the setting value 200° C. of the surface temperature of the roll shell 21. As shown at a time point t1 of FIG. 11, the temperature of the heat transfer fluid falls from 300° C. and the surface temperature of the roll shell 21 reaches the setting value 200° C., so that the surface temperature of the roll shell 21 is kept at 200° C. by the control signal outputted from the second temperature control circuit.

Thereafter, when the member to be processed 13 abuts against the surface of the roll shell 21 (at a time point t2 of FIG. 11), the temperature of the surface of the roll shell 21 reduces due to the heat absorption by the member to be processed 13. When the surface temperature of the roll shell 21 reduces below 170° C., the switching circuit 34 performs the switching operation thereby to send the control signal outputted from the first temperature control circuit to the electric power control circuit 11. Then, the electric power control circuit 11 supplies almost the maxim electric power to the heater 12. Thus, the temperature of the heat transfer fluid to be supplied to the roll shell 21 is increased as shown on and after the time point t2 in FIG. 11, and so the surface temperature of the roll shell 21 rapidly restores to the setting value 200° C. This operation is repeatedly performed while the member to be processed 13 abuts against and passes through the surface of the roll shell 21. Thus, together with the heat transfer speed, the temperature of the heat transfer fluid is kept at the temperature matching to the heat amount absorbed by the member to be processed 13, that is, the surface temperature of the roll shell 21 is kept at the setting value 200° C.

Further, in the case of absorbing heat from the member to be processed 13 thereby to reduce the temperature thereof to a predetermined temperature, the predetermined temperature is set to the target value S2 (second setting temperature) of the surface temperature of the roll shell 21, and a temperature lower than the target value S2 (second setting temperature) is set to the target value S1 (first setting temperature) of the temperature of the heat transfer fluid. Like the case of performing the heat processing, the temperature of the heat transfer fluid is kept at the temperature matching to a heat amount absorbed from the member to be processed 13 while the member to be processed 13 abuts against and passes through the surface of the roll shell 21. In other words, the surface temperature of the roll shell 21 can be kept at the predetermined temperature.

The aforesaid explanation of the temperature control is made as to the thermal processing roller which is provided with the rotary joint having an inlet and an outlet for the heat transfer fluid at one of the rotation driving shafts. Of course, the invention can be applied to the temperature control in the thermal processing roller which is provided with the inlet for the heat transfer fluid at one of the rotation driving shafts and the outlet for the heat transfer fluid at the other of the rotation driving shafts. Further, although the temperature sensor for the surface temperature of the roll shell is disposed at the thick portion of the roll shell, the sensor may be disposed at the outside near the surface of the roll shell as shown by a dotted line 35 in FIG. 11. Of course, as the occasion demands, both the arrangements may be combined. In the case of disposing the temperature sensor only at the outside of the roll shell, the rotating joint for taking out the surface temperature of the roll shell can be eliminated.

As described above, according to the thermal processing roller according to the invention, a flow rate of the heat transfer fluid flowing within the roller can be reduced to a large extent. Thus, a cost for the equipment can be reduced by employing the pipe and the pump of small sizes. Further, since an amount of radiation heat of the pipe and the capacity of the pump can be reduced, energy can be saved. That is, even if the temperature difference between the fluid inlet and the fluid outlet is large, the uniform thermal processing of the member to be processed can be performed. Further, according to the temperature control for the thermal processing roller according to the invention, even in the case where the surface temperature of the roller rises rapidly and an amount of the heat transfer fluid flowing within the roller is small, a time period required for increasing the surface temperature of the roller to a value near the setting temperature can be made short, and further the deviation between the surface temperature of the roller and the setting temperature can be made almost zero.

What is claimed is:

1. A thermal processing roller which includes a heat transfer medium flowing path therein and heats a member to be processed abutting against a surface of the roller or absorbs heat therefrom by a heat transfer fluid flowing through the heat transfer medium flowing path, wherein a sealed chamber extends in a longitudinal direction of the roller and in which a heat transfer medium having a vapor phase and a liquid phase is sealed, the chamber being formed within a thick portion of the roller.

2. A thermal processing roller according to claim 1, further comprising an electromagnetic induction heating mechanism.

3. The thermal processing roller according to claim 1, wherein the heat transfer fluid is flowed from outside of the roller to the heat transfer medium flowing path.

4. The thermal processing roller according to claim 1, wherein the heat transfer fluid comprises oil.

5. The thermal processing roller according to claim 1, wherein the heat transfer medium comprises water.

6. A thermal processing roller which includes a heat transfer medium flowing path therein and heats a member to be processed abutting against a surface of the roller or absorbs heat therefrom by a heat transfer fluid flowing through the heat transfer medium flowing path, wherein a plurality of sealed chambers each extend in a longitudinal direction of the roller and in each of which a heat transfer medium having a vapor phase and a liquid phase is sealed, each chamber being formed within a thick portion of the roller along an outer peripheral surface of the roller, tubes respectively penetrating within the sealed chambers in a longitudinal direction thereof are provided, and the tubes are used as the heat transfer medium flowing path.

7. A thermal processing roller according to claim 6, further comprising an electromagnetic induction heating mechanism.

8. The thermal processing roller according to claim 6, wherein the heat transfer fluid is flowed from an outside of the roller to the heat transfer medium flowing path.

9. The thermal processing roller according to claim 6, wherein the heat transfer fluid comprises oil.

10. The thermal processing roller according to claim 6, wherein the heat transfer medium comprises water.

11. A thermal processing roller comprising:

a roll shell;

a heat transfer medium flowing path for flowing a heat transfer fluid flowed from outside of the roll shell; and a sealed chamber formed in the roll shell, wherein a heat transfer medium having a vapor phase and a liquid phase is sealed in the sealed chamber.

12. The thermal processing roller according to claim 11, wherein the heat transfer medium flowing path penetrates within the sealed chamber.

13. The thermal processing roller according to claim 11, further comprising an electromagnetic induction heating mechanism.

14. The thermal processing roller according to claim 11, wherein the heat transfer fluid comprises oil.

15. The thermal processing roller according to claim 11, wherein the heat transfer medium comprises water.

* * * * *